United States Patent [19]

Porter

[11] 4,433,709

[45] Feb. 28, 1984

[54] DRYWALL HATCHET

[75] Inventor: Lawrence W. Porter, Ringwood, Ill.

[73] Assignee: Vaughan & Bushnell Manufacturing Co., Hebron, Ill.

[21] Appl. No.: 362,912

[22] Filed: Mar. 29, 1982

[51] Int. Cl.[3] ..... B26B 23/00

[52] U.S. Cl. ..... 145/2 R; 145/29 R

[58] Field of Search ..... 145/2 R, 29 R; 254/26 R

[56] References Cited

U.S. PATENT DOCUMENTS

| | | | |
|---|---|---|---|
| D. 115,256 | 6/1939 | Vaughan | 145/2 R |
| 1,168,890 | 1/1916 | Koehler | 145/2 R |
| 1,539,265 | 5/1925 | Mitchell | 145/2 R |
| 1,548,281 | 8/1925 | Reed | 254/26 R |

FOREIGN PATENT DOCUMENTS

| | | | |
|---|---|---|---|
| 20375 | of 1900 | United Kingdom | 145/29 R |

OTHER PUBLICATIONS

Vaughan & Bushnell Mfg. Co. Catalog No. 878, Copyright 1978, "More Than a Century . . . ", particularly page numbers 6, 7 and 12.

*Primary Examiner*—Frederick R. Schmidt
*Assistant Examiner*—J. T. Zatarga
*Attorney, Agent, or Firm*—Gerlach & O'Brien

[57] ABSTRACT

A striking tool such as a drywall hatchet for use in the installation of drywall panels in buildings and adapted for driving nails close to the junction of room surfaces, while minimizing damage to the panels, includes a head unit having a hammerhead portion, a medial body portion, and a blade portion. The hammerhead portion has a truncated disk-like configuration, providing a planar top marginal surface, and an arcuate side and bottom marginal surface extending around the hammerhead portion from one end of the top marginal surface to the opposite end thereof, and being convexly curved in the longitudinal direction of the head unit. The hammerhead portion has a convexly curved forwardly facing striking surface extending between the marginal surfaces, including a central milled area and a substantially smooth border completely therearound.

7 Claims, 9 Drawing Figures

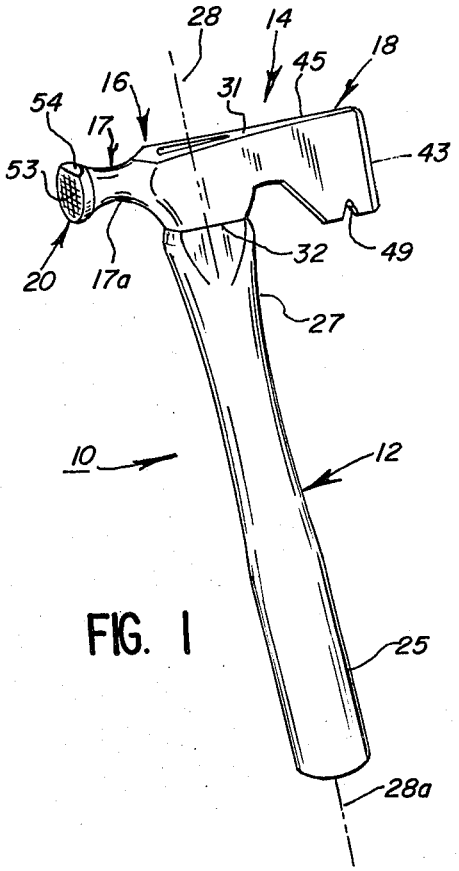
FIG. 1
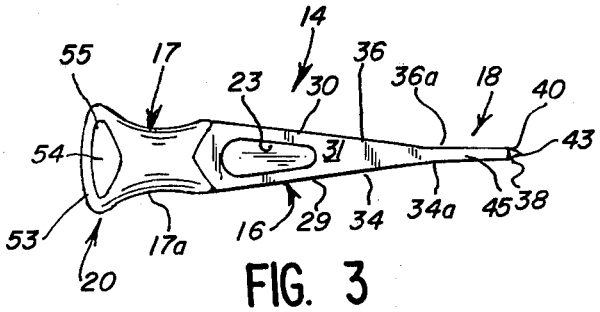
FIG. 3
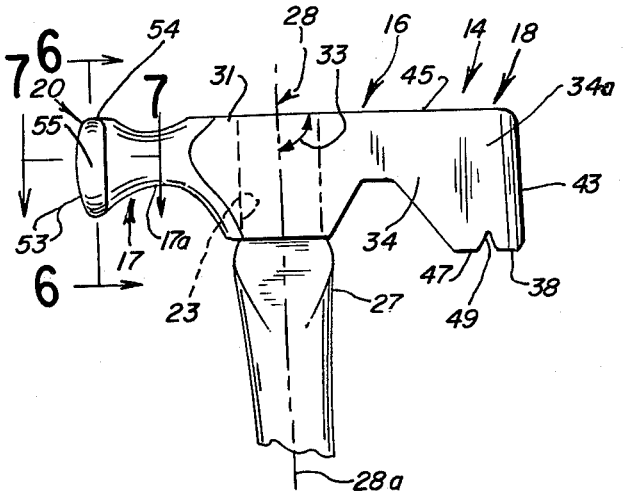
FIG. 2
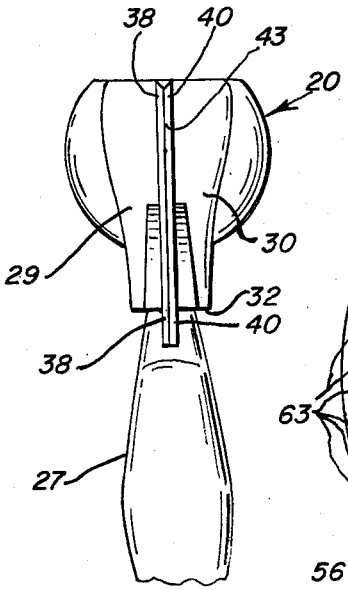
FIG. 5
FIG. 4
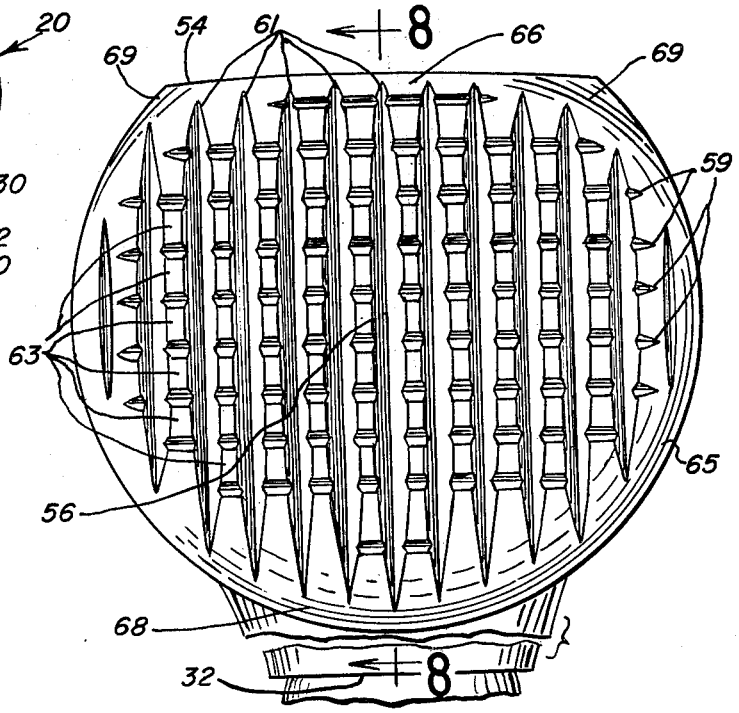

DRYWALL HATCHET

BACKGROUND OF THE INVENTION

This invention relates to portable striking tools, in particular, to a drywall striking tool.

In building construction using drywall (paper-encased gypsum core) panels, the panels are attached to supports, such as studs, by nails or other suitable fasteners. Professional drywall installers frequently use a specialized, relatively lightweight, striking tool for the nailing. One type of tool is termed a drywall (or wallboard) hatchet or hammer, and is designed for use in the installation of room wall and ceiling panels which are to be covered with a paint finish or the like, that does not hide surface irregularities. The drywall hatchet has a head unit which includes a medial body portion, a hammerhead portion projecting forwardly therefrom, and a blade portion projecting rearwardly therefrom. The hammerhead portion is symmetrical and disk-like in shape, and has a convex, or "crowned", striking surface, or face, for driving nails. Blunt serrations are provided in the central area of the striking surface, and a smooth border is provided therearound. The margin of the hammerhead portion is smooth and rounded. The blade portion is shaped like a hatchet blade or wedge and it is intended for cutting and/or wedging and prying panels.

The foregoing drywall hatchet facilitates the installation of panels in a manner such that they readily can be prepared so as to provide a smooth, flat surface suitable for painting. The convex striking surface of the hammerhead portion slightly compresses the gypsum core of the panel when the final blow of the tool is struck, to form a dimple or shallow concave depression in the panel surface. The nailhead is seated in the dimple and covered with filler, such as a drywall joint compound, and the surface of the panel is levelled. The serrations in the striking surface serve to grip the nailhead and to impress a waffle-like pattern on the surface of the dimple, which assists in holding the filler. The possibility of marring the surface of the panel by breaking or puncturing its paper facing is minimized for hammer blows which are square, or normal, to the panel surface, owing to the curvature of the striking surface, the bluntness of the serrations, and the smoothness of the border. The possibility of damage to the paper caused by an edgewise blow of the hammerhead portion is minimized by the smoothness of the border, the absence of serrations at the margin, and the roundness of the margin.

While the foregoing drywall hatchet is generally satisfactory for nailing panels, difficulties arise when it is used to drive a nail close to the intersection of two room surfaces, as, for example, at a wall-ceiling, wall-floor, and/or wall-wall junction. At such a location, the above-described configuration of the hammerhead, which lessens the chance of marring the panel surface, also makes it difficult to strike a blow with the striking surface square to and fully engaging the nailhead. A nail hit a glancing blow on the head frequently is bent, so that the nail either must be straightened before being driven in completely, or must be removed and replaced with a straight nail. Either course of action increases the possibility of damage to the panel and the installation time, with resulting increase in the cost of installation.

Other striking tools used in drywall panel installations include lathing hatchets, particularly those of the "Underhill" design. These tools are designed for installation of panels intended for surfacing with thick coatings, such as plaster, which conceal surface irregularities. The heads of nails used in such installations are, conventionally, driven flush with the panel surface rather than into a dimple in the surface.

The Underhill lathing hatchet has a head unit construction which allows it to be used for driving nails in close proximity to the junction of several surfaces. However, the construction of the striking surface of the lathing hatchet makes it relatively unsuitable for use in installing drywall panels which are to be finished by painting or similar methods. Thus, the lathing hatchet has a hammerhead portion which is substantially square in shape and has generally flat top, side, and bottom surfaces. The top surface is substantially coplanar with the top surfaces of the hatchet body and blade portions. These characteristics allow the hammerhead portion to strike nails close to an adjoining surface. However, the striking surface has relatively sharply pointed serrations, and the serrations extend close to the several flat surfaces. The latter characteristics of the lathing hatchet make it difficult to form a dimple in the surface of a drywall panel without breaking or puncturing its paper facing.

Other tools have hammerhead portions which resemble the hammerhead portion of the lathing hatchet and suffer from the same deficiencies. They include box, roofing, and shingling hatchets.

SUMMARY OF THE INVENTION

The present invention provides an improved head unit for a striking tool of a type used for installation of drywall panels. The head unit is adapted to deliver blows with a hammerhead portion thereof square to and in full engagement with a nailhead, even when the nail is located close to the juncture of two surfaces. The hammerhead portion of the head unit is further adapted to provide a waffle-patterned dimple in the surface of a drywall panel, by a blow to the surface, for nail-hiding purposes, while minimizing the possibility of marring the surface of the panel by such a blow, either square or oblique. The new head unit may be manufactured by a similar method and without substantial increase in cost as compared to the above-described conventional unit.

The head unit of the invention includes a medial body portion, a hammerhead portion projecting longitudinally forwardly from the body portion, and blade portion projecting longitudinally rearwardly from the body portion. The hammerhead portion comprises a transversely extended truncated disk-like portion bounded by a substantially planar top marginal surface extending transversely between opposite ends thereof, and an arcuate side and bottom marginal surface extending substantially circularly around the disk-like portion from one of the ends of the top marginal surface to the opposite end thereof. The side and bottom marginal surfaces are convexly curved in the longitudinal direction of the head unit. The disk-like portion has a forwardly facing convexly curved striking surface extending between the marginal surfaces. The striking surface includes a convexly curved central milled area having a plurality of serrations therein, and a convexly curved substantially smooth border of continuous curvature with the milled area, the border extending between the milled area and the marginal surfaces completely around the striking surface, the striking surface thereby being free of prominent serrations.

In preferred embodiments of the invention, the body and blade portions of the head unit have planar top surfaces which are substantially coplanar with the top marginal surface of the hammerhead portion, and the border of the striking surface includes a portion adjacent to the top marginal surface having a radius of curvature that is less than the radius of curvature of the remainder of the border.

BRIEF DESCRIPTION OF THE DRAWINGS

The drawings illustrate a preferred embodiment of the striking tool of the invention, without limitation thereto. In the drawings, like elements are identified by like reference symbols in each of the views, and:

FIG. 1 is a perspective view of a drywall hatchet constructed in accordance with the invention;

FIG. 2 is an enlarged fragmentary side elevational view thereof;

FIG. 3 is an enlarged top plan view thereof;

FIG. 4 is a further enlarged fragmentary front end elevational view thereof;

FIG. 5 is a fragmentary rear elevational view thereof, on a smaller scale than FIG. 4;

DESCRIPTION OF THE PREFERRED EMBODIMENT

Figure 6:
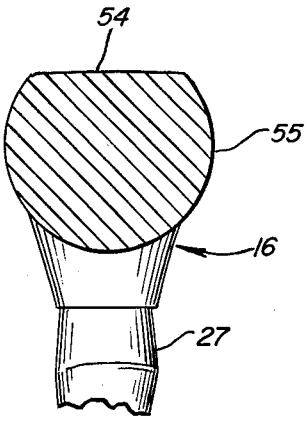
FIG. 6 is a fragmentary cross-sectional view thereof, taken substantially on line 6—6 of FIG. 2, on a larger scale.

Referring to the drawings, particularly FIGS. 1, 2 and 3, a drywall hatchet 10 constructed in accordance with the invention includes a wooden handle 12 and a forged steel head unit 14. The head unit 14 includes a medial body portion or section 16, and, projecting outwardly from opposite ends thereof, a longitudinally forwardly extending constricted neck portion or section 17 and a longitudinally rearwardly extending blade portion or section 18. A truncated disk-like hammerhead portion 20 extends longitudinally forwardly from the forward end of the neck portion 17.

The body portion 16 has opposite, substantially planar, rearwardly converging side surfaces 29 and 30, between which extend at the upper margins thereof a substantially planar top surface 31 normal thereto, and at the lower margins thereof a substantially planar bottom surface 32 normal thereto. The body portion 16 is provided with a socket or opening 23 extending transversely therethrough, between the top and bottom surfaces 31 and 32. The socket 23 has a longitudinal axis 28 that intersects the plane of the top surface 31 at an acute angle 33.

The handle 12 includes a proximal grip portion 25 and a distal connecting portion 27, and it has a longitudinal axis 28*a*. The connecting portion 27 is inserted into the socket 23 and is secured therein by wedge means (not shown), to mount the head unit 14 on the handle 12. The longitudinal axis 28 of the socket 23 coincides with or is parallel to the longitudinal axis 28*a* of the handle 12, and both axes are inclined, or raked, rearwardly toward the blade portion 18 at the rake angle 33. In the illustrative preferred embodiment, the angle 33 is about 85°. The function of the rearward inclination of the handle 12 is described hereinafter.

The blade portion 18 has opposite side surfaces 34 and 36, which are continuous with and merge rearwardly from the side surfaces 29 and 30, respectively, of the body portion 16, and which terminate in substantially parallel surface areas 34*a* and 36*a*. The rear end of the blade portion 18 is bevelled on opposite sides, as indicated at 38 and 40, to form a cutting edge 43 on the blade portion. Alternatively, the edge 43 may be blunt, and the blade portion 18 then is used principally for prying or wedging purposes. Each variation of the tool is designated in the trade alternatively as a "hatchet" or a "hammer", and the term "hatchet" is used in the specification and claims hereof to include the several variations having a hatchet-like blade portion.

The blade portion 18 has a substantially planar top surface 45, which is continuous and coplanar with the top surface 31 of the body portion 16, and which extends between the side surfaces 34 and 36 and the bevelled surfaces 38 and 40 of the blade portion at their upper margins, normal thereto. The blade portion 18 has a bottom surface 47 extending between the side surfaces 34 and 36 and the bevelled surfaces 38 and 40 at their lower margins. A V-shaped nail slot or notch 49 in the blade portion 18 extends inwardly from the bottom surface 47.

The neck portion 17 in the illustrative embodiment tapers along curved lines, forwardly from the body portion 16, and rearwardly from the hammerhead portion 20, to a location 17*a* of generally circular cross section and minimum diameter, which is approximately midway between the body portion and the hammerhead portion. The foregoing construction of the body portion 16, the neck portion 17, and the blade portion 18 is the same as the construction of such portions in the prior drywall hatchet first described hereinabove.

Referring to FIGS. 1–8, the hammerhead portion 20 has the general configuration of a transversely extending disk with the upper portion thereof cut off by a plane. The hammerhead portion 20 has a forwardly or front-facing convexly curved or "crowned" striking surface 53, a transversely extending substantially planar top marginal surface 54, and an arcuate side and bottom marginal surface 55 extending substantially circularly around the hammerhead portion between opposite ends of the top surface 54.

Figure 7:
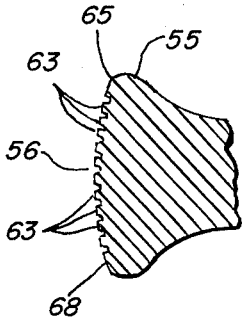
FIG. 7 is a fragmentary cross-sectional view thereof, taken substantially on line 7—7 of FIG. 2, on the same scale as FIG. 6.
Figure 8:
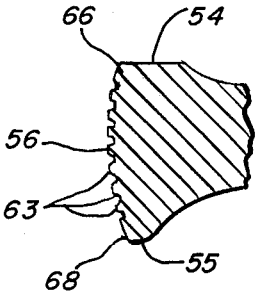
FIG. 8 is a fragmentary cross-sectional view thereof, taken substantially on line 8—8 of FIG. 4, on the same scale as FIG. 6.

Referring particularly in FIGS. 4, 7, and 8, a grid of spaced apart, parallel horizontal grooves 59, and spaced apart, parallel vertical grooves 61, is formed in a convexly curved central milled area 56 of the striking surface 53. Truncated pyramidal serrations or teeth 63 remain between the grooves 59 and 61 in the milled area. The serrations 63 are generally rectangular in cross section, and they have convexly curved outer surfaces, forming parts of the striking surface 53.

The striking surface 53 also includes a substantially smooth, convexly curved border 65, of continuous curvature with the milled area 56 and extending from the milled area to the marginal surfaces 54 and 55, completely around the striking surface. The border 65 includes a transversely extending portion 66 extending from the milled area 56 to the top marginal surface 54 along the latter, and a substantially circular arcutate portion 68 extending from the milled area to the side and bottom marginal surface 55 around the latter. The border 65 also includes two short joining portions 69, which extend from the milled area 56 to the marginal surfaces 54 and 55 at their junctions and merge the opposite ends of the transverse portion 66 into the arcuate portion 68. The transverse portion 66 of the border 65, adjacent to the top marginal surface 54, has a radius of curvature that is less than the radius of curvature of the remainder of the border.

Referring to FIGS. 2, 3, 7, and 8, the planar top marginal surface 54 of the hammerhead portion 20 extends rearwardly from the border 65, to the neck portion 17, which has a continuing coplanar surface extending over the front end thereof. The side and bottom marginal surface 55 is convexly curved in the longitudinal direction of the head unit 14, and it extends from the border 65 to the neck portion 17, substantially merging with the surface of the latter.

In the preferred illustrative embodiment, the top surface 31 of the body portion 16, the top surface 45 of the blade portion 18, and the top marginal surface 54 of the hammerhead portion 20 are substantially coplanar. Alternatively, the body portion top surface 31 and the blade portion top surface 45 might lie in a plane or planes below, or inwardly of, the plane of the hammerhead portion top marginal surface 54.

The head unit 14 is constructed of steel in a generally conventional manner for this type of hatchet. Thus, the head unit initially is cold-forged and roughground. The grooves 59 and 61 are formed in the striking surface 53 by milling. The head unit 14 next is heat-treated, ground and polished. This final grinding serves to finish the above-described surfaces. In the final grinding of the striking surface 53, the border 65 thereof is ground substantially smooth, in the process substantially eliminating any ends of the grooves 59 and 61 which otherwise would extend to the marginal surfaces 54 and 55.

The continuous curvature of the striking surface 53 results in a surface free of prominent serrations, such as might damage wallboard panel facing. At the same time, the serrations 63 are brought relatively close to the top marginal surface 54, by the provision of a lesser radius of curvature of the transverse border portion 66, resulting in the border portion being relatively narrow, as compared to the conventional drywall hatchet. As seen in FIG. 4, horizontal rows of serrations 63 are provided near to the top marginal surface 54, for striking a nailhead adjacent to such surface, squarely and fully engaged by the milled area 56.

The curvature of the striking surface 53 serves to produce a dimple or depression in the surface of a drywall panel, while the milled area 56 is sufficiently flat that it makes full engagement with a nailhead when struck squarely. An exemplary radius of curvature of the striking surface 53 is approximately three inches, except for the transverse border portion 66, of lesser radius. The milled area 56 produces the desired waffle pattern in the panel surface, with minimal possibility of damage thereto. The curvature of the border 65 and the curvature of the side and bottom marginal surface 55 minimize marring of the panel surface due to oblique blows.

The new hammer 10 having the head unit 14 may be used to drive nails into a drywall panel as close as ¼ inch from the surface of an adjoining wall, ceiling or floor. The truncated or "squared off" hammerhead portion 20 provides an elongated serrated striking area adjacent to the top marginal surface 54 that is substantially greater than the striking area available at the top of the conventional circular hammerhead portion. Also, the point at which a nailhead is struck is closer to the center of the circle defining the side and bottom marginal surface 55, and thereby closer to the center of the driving force exerted by the hammerhead unit upon striking a blow. Accordingly, the hammer blows are more likely to be true and less likely to be misdirected, thereby reducing the incidence of bent nails and damaging blows to the panel surface.

Figure 9:
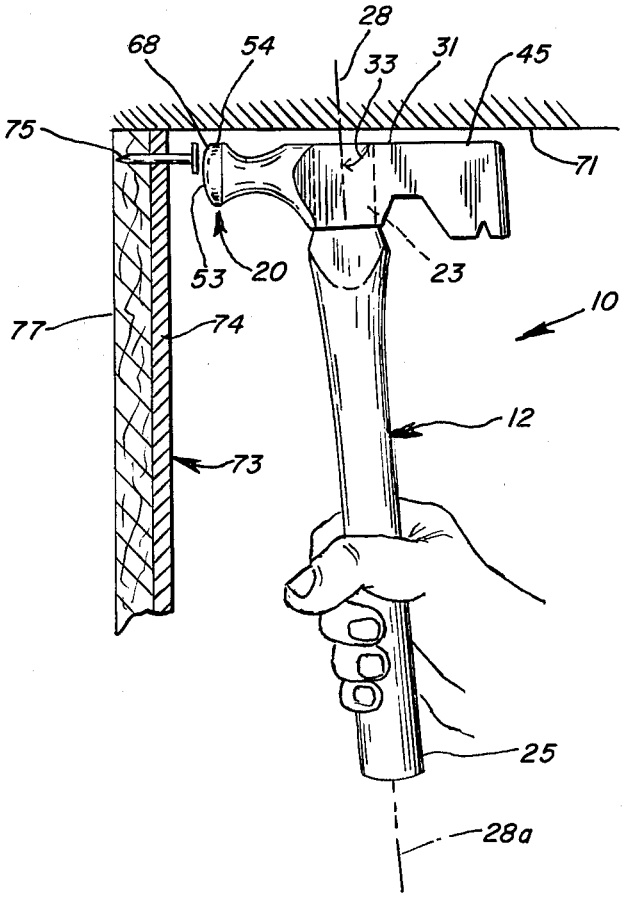
FIG. 9 is a diagrammmatic representation of the hatchet in use, in close proximity to the intersection of a ceiling and a wall, for driving a nail through a drywall panel and into a wall stud.

The use of the drywall hatchet 10 as a hammer, with the foregoing advantages, is illustrated in FIG. 9. The hatchet 10 there is illustrated in use at the intersection of a ceiling 71 and a wall 73 being constructed with a drywall panel 74. A nail 75 is illustrated as being driven through the panel 74 and into a stud 77. The nail 75 is close to the ceiling 71, making it difficult to strike the nailhead squarely. When a blow is struck, the upper portion of the striking surface 53 is substantially square to the nailhead, and the coplanar top surfaces 31, 45 and 54 on the head unit 14 clear or are spaced from the ceiling 71, without interference caused by the ceiling, although necessarily in close proximity thereto. The handle 12 of the hammer, being rearwardly inclined at the rake angle 33, is sufficiently spaced from the wall 73 to provide clearance for the user's fingers, around the grip portion 25 of the handle.

While a preferred embodiment of the striking tool of the invention has been described and illustrated, it will be apparent to those skilled in the art that various changes and modifications may be made therein, within the spirit and scope of the invention. It is intended that all such changes and modifications be included within the scope of the appended claims.

I claim:

1. In a head unit for a drywall striking tool including a medial body portion, a hammerhead portion projecting longitudinally forwardly from the body portion, and a blade portion projecting longitudinally rearwardly from the body portion, the improvement wherein said hammerhead portion comprises a transversely extending truncated disk-like portion bounded by a substantially planar top marginal surface extending transversely between opposite ends thereof, and an arcuate side and bottom marginal surface extending substantially circularly around the disk-like portion from one of said ends of the top marginal surface to the opposite end thereof, said side and bottom marginal surface being convexly curved in the longitudinal direction of the head unit, said disk-like portion having a forwardly facing convexly curved striking surface extending between said marginal surfaces, said striking surface including a convexly curved central milled area having a plurality of serrations therein, and a substantially smooth convexly curved border of continuous curvature with said milled area, and said border extending from said milled area to said marginal surfaces completely around said striking surface, said striking surface thereby being free of prominent serrations.

2. A head unit as defined in claim 1 and wherein said border includes a portion extending transversely adjacent to said top marginal surface having a radius of curvature that is less than the radius of curvature of the remainder of the border.

3. A head unit as defined in claim 1 or 2 and wherein said serrations are of substantially truncated pyramidal configuration.

4. A head unit as defined in claim 1 or 2 and wherein each of said body and blade portions includes a substantially planar top surface which is substantially coplanar with said top marginal surface.

5. A head unit as defined in claim 4 and including means for mounting a handle on said body portion to extend rearwardly and downwardly therefrom at an acute angle to the plane of said top surface thereof.

6. A head unit as defined in claim 4 and including a constricted neck portion joining said disk-like portion to said body portion.

7. A drywall striking tool comprising: a head unit including a medial body portion having a substantially planar top surface, a constricted neck portion projecting longitudinally forwardly from the body portion, a hammerhead portion projecting longitudinally forwardly from the neck portion, a blade portion projecting longitudinally rearwardly from the body portion and having a substantially planar top surface, and means on the body portion for mounting a handle thereon to extend rearwardly and downwardly therefrom at an acute angle to the plane of said top surface thereof, said hammerhead portion comprising a transversely extending truncated disk-like portion bounded by a substantially planar top marginal surface extending transversely between opposite ends thereof and substantially coplanar with said top surfaces of said body and blade portions, and an arcuate side and bottom marginal surface extending substantially circularly around the disk-like portion from one of said ends of the top marginal surface to the opposite end thereof, said side and bottom marginal surface being convexly curved in the longitudinal direction of the head unit, said disk-like portion having a forwardly facing covexly curved striking surface extending between said marginal surfaces, said striking surface including a convexly curved central milled area having a plurality of truncated pyramidal serrations therein, and a substantially smooth convexly curved border of continuous curvature with said milled area, said border extending from said milled area to said marginal surfaces completely around said striking surface, said striking surface thereby being free of prominent serrations, and said border including a portion extending transversely adjacent to said top marginal surface having a radius of curvature that is less than the radius of curvature of the remainder of the border; and a handle mounted on said mounting means.

* * * * *